United States Patent [19]

Sunshine et al.

[11] 4,274,591

[45] Jun. 23, 1981

[54] WATER PROPELLED HOVER DEVICE

[75] Inventors: Richard B. Sunshine; Randall D. Severen, both of Dallas, Tex.

[73] Assignee: The Cona Company, Inc., Dallas, Tex.

[21] Appl. No.: 26,285

[22] Filed: Apr. 2, 1979

[51] Int. Cl.[3] ..... B05B 3/00; A63H 29/10

[52] U.S. Cl. ..... 239/188; 46/41; 46/91; 46/74 D; 239/192; 239/251; 239/211

[58] Field of Search ..... 46/91, 75, 41, 74 D, 46/82; 239/188, 192, 225, 251, 211; 244/12.2, 23 C

[56] References Cited

U.S. PATENT DOCUMENTS

| | | | |
|---|---|---|---|
| 1,002,381 | 9/1911 | Ford | 239/192 |
| 2,560,833 | 7/1951 | Wagner | 46/41 |
| 2,573,687 | 11/1951 | Brock | 239/251 X |
| 2,640,296 | 6/1953 | Johnson et al. | 46/74 D X |
| 2,835,073 | 5/1958 | Dame | 46/74 D X |
| 2,921,743 | 1/1960 | Westover et al. | 239/188 |
| 2,937,473 | 5/1960 | Vlachos | 46/75 |
| 2,954,932 | 10/1960 | Albano | 239/188 |
| 3,093,927 | 6/1963 | Smith | 46/75 |
| 3,172,230 | 3/1965 | Smith | 46/75 |
| 3,176,984 | 4/1965 | Sullivan | 272/31 |
| 3,532,303 | 10/1970 | Farkas | 244/23 C |
| 3,662,487 | 5/1972 | Seefluth | 46/44 |
| 3,679,136 | 7/1972 | Snyder | 239/188 |
| 3,700,172 | 10/1972 | Gallegos, Sr. | 239/188 |
| 4,047,666 | 9/1977 | Hart | 239/251 |

*Primary Examiner*—Gene Mancene
*Assistant Examiner*—Mickey Yu
*Attorney, Agent, or Firm*—Richards, Harris & Medlock

[57] ABSTRACT

A water propelled hover toy (10) comprises a circular body (24) with a fluid supply chamber (36) affixed thereto. The body (24) is rotatably secured at an inlet port to the supply chamber (36) to a launch tube (12), which is connected to a water line by means of tubing (14). The sections of tubing (12, 14) are preferably coupled together by means of a rotary connection (22). In each of the embodiments, the body (24) is preferably configured to generate lift during rotation.

9 Claims, 12 Drawing Figures

WATER PROPELLED HOVER DEVICE

TECHNICAL FIELD

The present invention relates generally to a liquid discharge and distribution device adapted to be connected in a rotatable manner to a liquid pressure supply. More particularly, the present invention concerns a water propelled hover toy.

BACKGROUND ART

Various designs of flying toys have heretofore been developed. Such toys generally comprise either free flight devices or devices which are captive or tethered in some manner.

A popular means of powering flying toys has been the reactionary forces or jet action generated by fluid flow through a nozzle. A readily available source of fluid power, particularly with respect to captive flying toys, has been the water pressure in an ordinary water line. Unfortunately, however, several problems accompany the utilization of water pressure from a water line to power a flying toy. For example, the weight of the water carried in the connection between a flying toy and a water faucet tends to adversely effect performance of the toy. The connection itself must permit movement of the toy without undue interference. The flying toy should be relatively stable during propulsion. The water propelled flying toys of the prior art have been generally unstable, unpredictable and incapable of hovering at a height sufficient to permit children to play beneath the toy. There is thus a need for an improved water propelled flying toy which is capable of hovering in stabilized fashion.

DISCLOSURE OF INVENTION

The present invention comprises a water propelled hover toy which overcomes the foregoing and other difficulties associated with the prior art. In accordance with the invention, there is provided a novel hover toy having a circular body which is preferably configured to generate lift during rotation. The body includes a fluid chamber with an inlet rotatably connected to a source of fluid under pressure. The hover toy is particularly suited for operation by ordinary water pressure. A plurality of outlets extending from the chamber discharge the fluid outwardly and downwardly to rotate and lift the body. The flying toy of the present invention hovers above the ground stabilized by gyroscopic action.

In accordance with more specific aspects of the invention, a novel hover toy comprises a circular body. In some inventive embodiments, the body includes a concave surface and a convex surface. In another embodiment, the body includes a plurality of vanes extending between a center portion and an outer rim. Preferably, the circular body is configured to generate lift during rotation. The body includes a fluid chamber having an inlet located along the spin axis of the body. The body is rotatably secured at the inlet to one end of a length of tubing connected to a water faucet. In accordance with the preferred construction, the tubing includes a section of flexible tubing rotatably connected to a section of semi-rigid tubing. Discharge tubes are connected to outlets in the water chamber of the body. The terminal ends of the discharge tubes are oriented to direct water downwardly to lift the toy, and outwardly to spin and stabilize the toy. In another embodiment, the body is secured via a ball-joint connection to a section of tubing attached to a stand.

BRIEF DESCRIPTION OF DRAWINGS

A more complete understanding of the invention can be had by referring to the following Detailed Description in conjunction with the accompanying Drawings, wherein.

DETAILED DESCRIPTION

Figure 1:
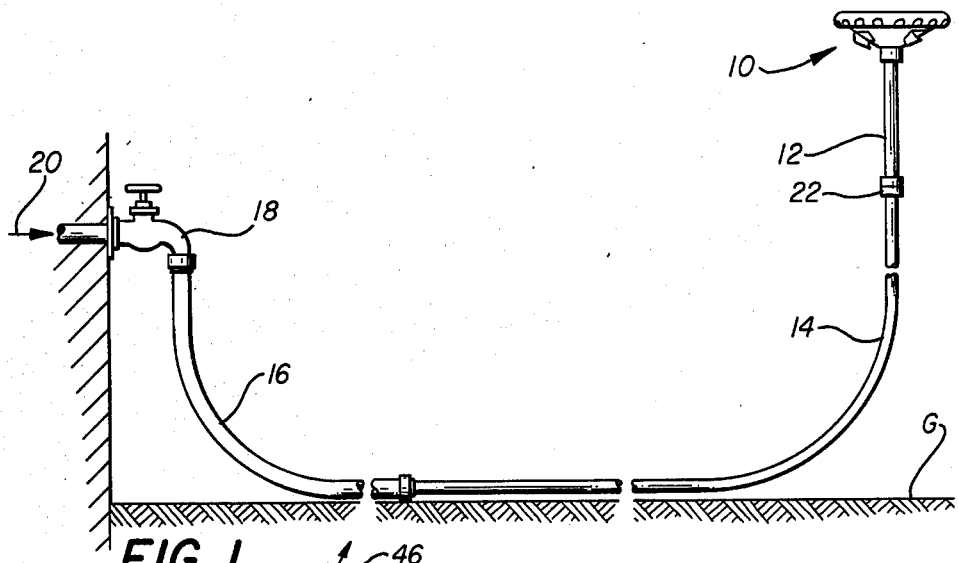
FIG. 1 is an illustration of a first embodiment of the hover toy of the present invention connected to a source of fluid.

Referring now to the Drawings, and particularly to FIG. 1 thereof, there is shown a novel hover toy 10 incorporating a first embodiment of the present invention. The hover toy 10 utilizes water propulsion for lifting and spinning the toy to achieve stable hovering flight above the ground G.

The hover toy 10 is mounted for rotation at one end of a rigid or semi-rigid launch tube 12. The lower end of the launch tube 12 is connected to a length of flexible tubing 14, which is coupled to a section of garden hose 16 extending from a water faucet 18.

The hover toy 10 is especially suited for operation by the pressure in a water utilities line, which can be between approximately 40 and 70 psi. Water flowing in the direction of arrow 20 is thus directed to the spinning toy 10 for downward and outward discharge from nozzles to be described more fully hereinafter.

The launch tube 12 and tubing 14 are preferably formed of lightweight material, such as plastic or the like. If desired, the launch tube 12 and flexible tubing 14 can be of reduced internal diameters to decrease the volume and thus weight of fluid carried in the lines, while increasing the flow velocity and thereby improving the performance of the toy 10 at a given water pressure. For example, tube 12 and tubing 14 can be of approximately ⅜ inch internal diameters. In accordance with the preferred construction, the launch tube 12 and flexible tubing 14 are interconnected by a swivel or rotary connection 22 so that the tubing and the hose 16 are prevented from twisting, which would tend to destabilize the hover toy 10 during operation.

Figure 2:
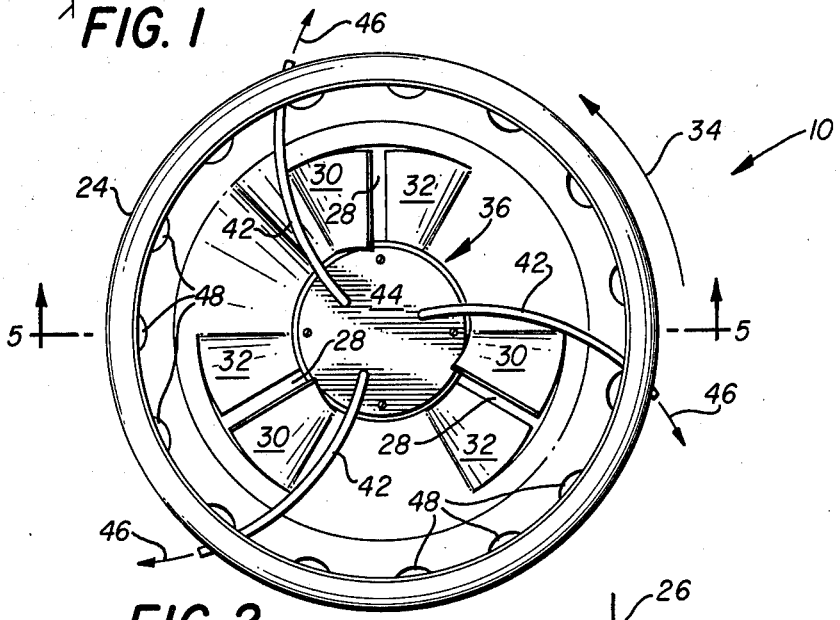
FIG. 2 is an enlarged top view of the embodiment shown in FIG. 1.
Figure 3:
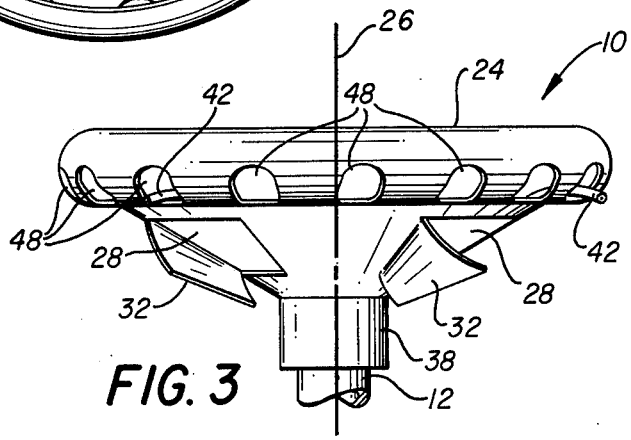
FIG. 3 is a side view of FIG. 2.
Figure 4:
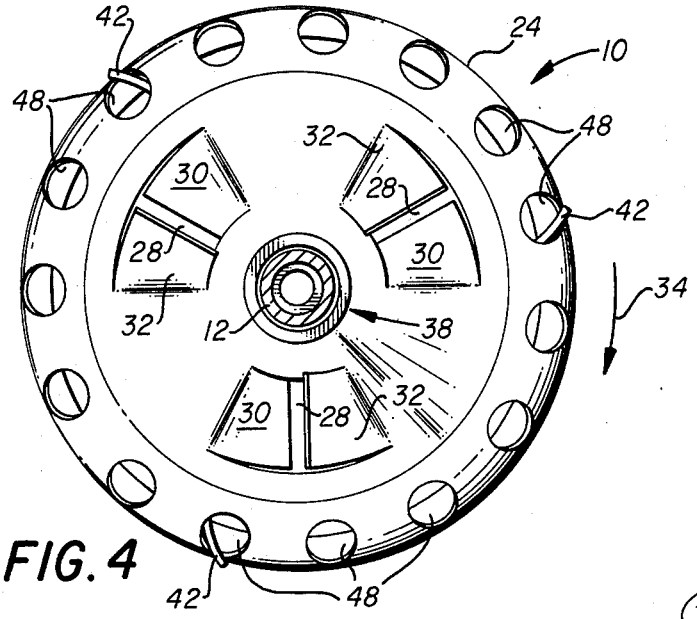
FIG. 4 is a bottom view of FIG. 2.

Referring to FIGS. 2, 3 and 4, there are shown enlarged views of the hover toy 10. The hover toy 10 includes a generally circular body 24 having a bowl-shaped configuration. The body 24 is preferably constructed of a lightweight material, such as plastic or the like. If desired, a conventional concave-convex flying toy of the type suited for throwing through the air in free flight can be modified to serve as the body 24. The circular body 24 is substantially symmetrical about the spin axis 26, which is best shown in FIG. 3. While the preferred form of body 24 is circular, the body could be rectangular, hexagonal or multi-sided if desired.

The body 24 of the hover toy 10 includes a plurality of vent openings 28 positioned in circumferentially spaced apart relationship. Each vent opening 28 includes a leading vane or flap 30 and a trailing vane or flap 32. The flaps 30 and 32 of each vent opening 28 are angled in opposite directions. Leading flaps 30 are bent upwardly and face away from the direction of rotation of the hover toy 10. Arrow 34 indicates the rotational direction of the hover toy 10. Trailing flaps 32 are angled downwardly and face in the direction of rotation of the hover toy 10. It will thus be appreciated that trailing flaps 32 serve to gather and collect air through vent openings 28, thereby generating lift as the hover toy 10 rotates.

Figure 5:
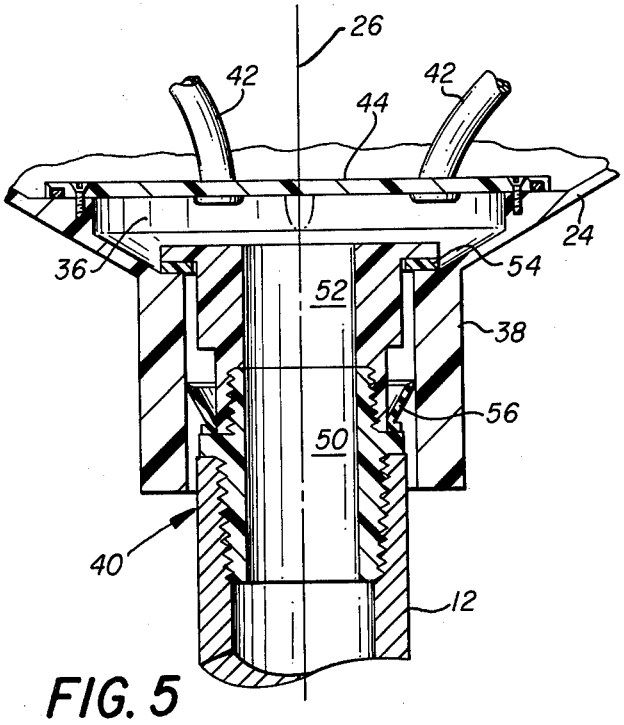
FIG. 5 is an enlarged cross sectional view of the water chamber in the first inventive embodiment.

Referring to FIG. 5 in conjunction with FIG. 2, the hover toy 10 includes a fluid supply chamber 36 for receiving fluid from the launch tube 12. The fluid chamber 36 is attached to or formed integrally with the body 24. The chamber 36 is preferably positioned on the body 24 along the spin axis 26. A circular upset or collar 38 extending from the underside of the body 24 defines an inlet port for the fluid chamber 36. The hover toy 10 is rotatably secured to the launch tube 12 by means of a suitable swivel or rotary connection 40 between the collar 38 and the upper end of the launch tube.

A plurality of outlet tubes 42 are connected to the fluid chamber 36 through the upper wall 44 of the chamber. Fluid received in the chamber 36 is discharged therefrom through the tubes 42. For purposes of illustration, the hover toy 10 is shown utilizing three tubes 42, however it will be understood that any desired number of outlet tubes can be employed. The outlet tubes 42 direct the fluid from chamber 36 for discharge outwardly in the directions of arrows 46 shown in FIG. 2. Outlet tubes 42 are directed downwardly at an angle selected between the vertical and horizontal, and rearwardly at an angle between the tangent and radial. In accordance with the preferred construction, the outlet tubes 42 comprise sections of plastic tubing having internal diameters of about $\frac{1}{8}$ inch. The terminal ends of outlet tubes 42 extend through openings 48 provided about the outer rim of body 24. Preferably, a plurality of circumferentially spaced apart openings 48 are formed in the body 24 for decoration and weight reduction purposes. According to the preferred construction of the invention, the terminal end of each outlet tube 42 is angled downward at approximately 45° to the horizontal, and extends substantially tangentially or slightly outwardly from the body 24 in a direction opposite to the rotational direction. It will thus be understood that fluid issuing from outlet tubes 42 serves both to lift and rotate the hover toy 10.

Figure 6:
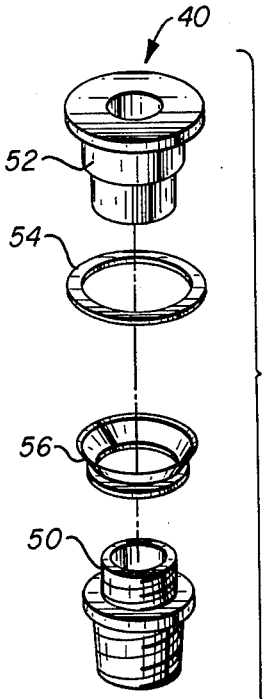
FIG. 6 is an exploded view of a portion of FIG. 5.

Referring to FIGS. 5 and 6, there are shown the constructional details of the rotary connection 40 between the launch tube 12 and the hover toy 10. Any suitable swivel or rotary connection can be employed. For example, the rotary connection 40 illustrated may be of the type which is typically used in lawn sprinklers, such as that manufactured by L. R. Nelson Corporation of Peoria, Illinois. Such a rotary connection 40 comprises a first plug 50 threadedly secured to one end of the launch tube 12. The launch tube 12 is stationary relative to the spinning hover toy 10. Threadedly secured to the first plug 50 is a second plug 52, which includes a shoulder bearing on a thrust washer 54 supported by a cooperating surface in the hover toy 10. A feather washer 56 prevents fluid leakage around plugs 50 and 52. The swivel connection 40 thus comprises a rotary union to allow fluid flow to the rotating hover toy 10.

If desired, the swivel connection 22 between the launch tube 12 and the flexible tubing 14 can be constructed similarly to the swivel connection 40 shown in FIGS. 5 and 6. The purpose of swivel connection 22 is to isolate any residual rotation of the launch tube 12 from the flexible tubing 14, which rotation otherwise would tend to twist the tubing and upset the hover toy 10.

Figure 7:
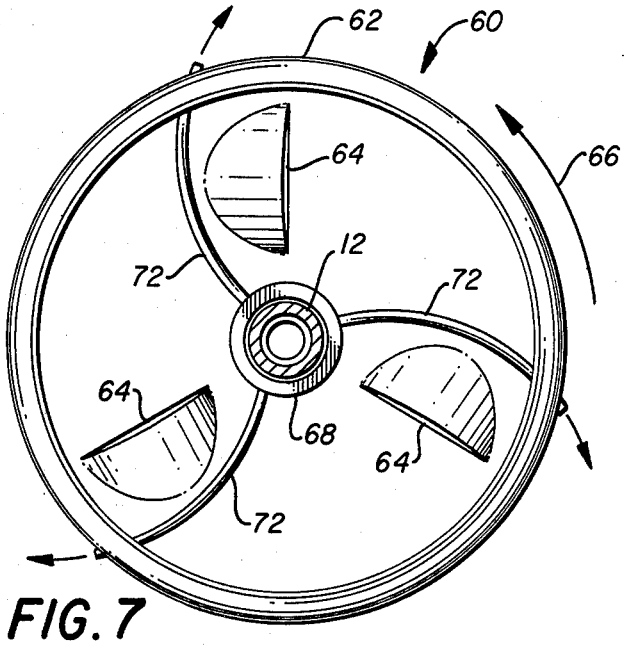
FIG. 7 is a bottom view of a second embodiment of the invention.
Figure 8:
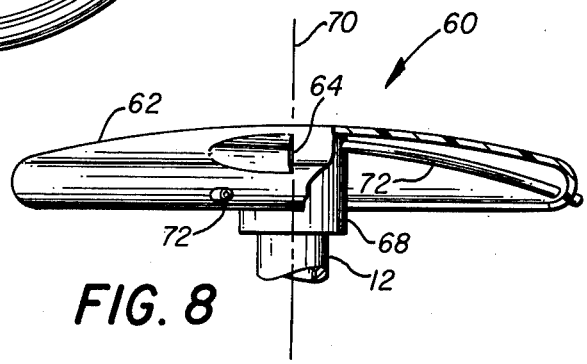
FIG. 8 is a side view (partially cut away) of FIG. 7.

Referring now to FIGS. 7 and 8, there is shown a hover toy 60 incorporating a second embodiment of the invention. In this embodiment, the hover toy 60 includes a circular body 62 comprising a modified concave-convex flying toy of the type which is thrown through the air with a spinning motion. A plurality of circumferentially spaced apart louvers 64 are formed into the body 62 to collect air underneath the body during rotation of the toy in the direction of arrow 66. A fluid supply chamber 68 of a construction similar to that hereinbefore described is attached to the underside of the body 62 along the spin axis 70. A plurality of outlet tubes 72 extend from the supply chamber 68 so that fluid is discharged in a manner hereinbefore described to rotate and lift the hover toy 60. The hover toy 60 is rotatably secured to the launch tube 12 by means of a swivel connection similar to the swivel connection 40 described in conjunction with the first embodiment of the invention.

Figure 9:
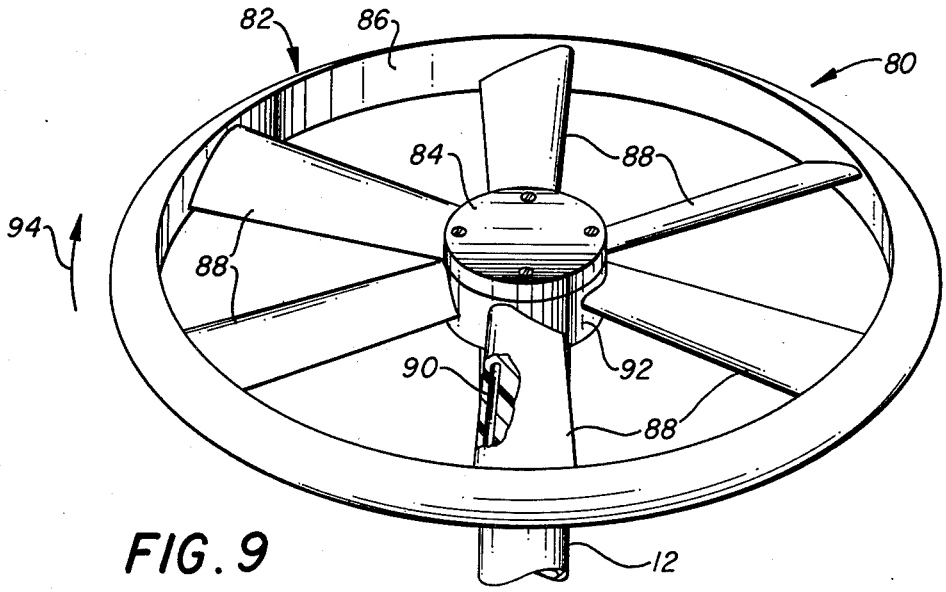
FIG. 9 is a perspective view of a third embodiment of the invention.

Referring to FIG. 9, there is shown a hover toy 80 incorporating a third embodiment of the invention. The hover 80 includes a body 82 comprising a center portion 84 connected to an outer rim 86 by means of a suitable plurality of air foils or vanes 88. At least some of the vanes 88 house outlet tubes 90 connected to a fluid supply chamber 92 located in the inner portion 84. The outlet tubes 90, only one of which is shown, discharge the fluid outwardly in the manner hereinbefore described in order to rotate the hover toy 80 in the direction of arrow 94. The fluid supply chamber 92 located within the inner portion 84 is constructed similarly to chamber 36 described with regard to the first embodiment of the invention. The hover toy 80 is rotatably secured to the launch tube 12 through a swivel or rotary connection, such as rotary connection 40 described in conjunction with the hover toy 10 shown in FIGS. 2–6.

The hover toys 10, 60 and 80 embodying the present invention operate as follows. The toy is rotatably secured to the launch tube 12, which is connected by means of flexible tubing 14 to a water faucet. Grasping the toy by the launch tube 12, the water is then turned on. As soon as enough lift is generated by the spinning toy, the launch tube 12 can be released whereupon the toy will seek equilibrium and hover in stabilized fashion over ground G. During actual operation, the toy and launch tube may wander or precess slightly. Water sprays downwardly in spirals from the spinning toy as it hovers. The hover height of the toy can be changed by controlling the water flow to it. In actual practice, hover heights of between 5 and 10 feet have been achieved. Stopping water flow to the toy will allow it to fall back to ground G.

Figure 10:
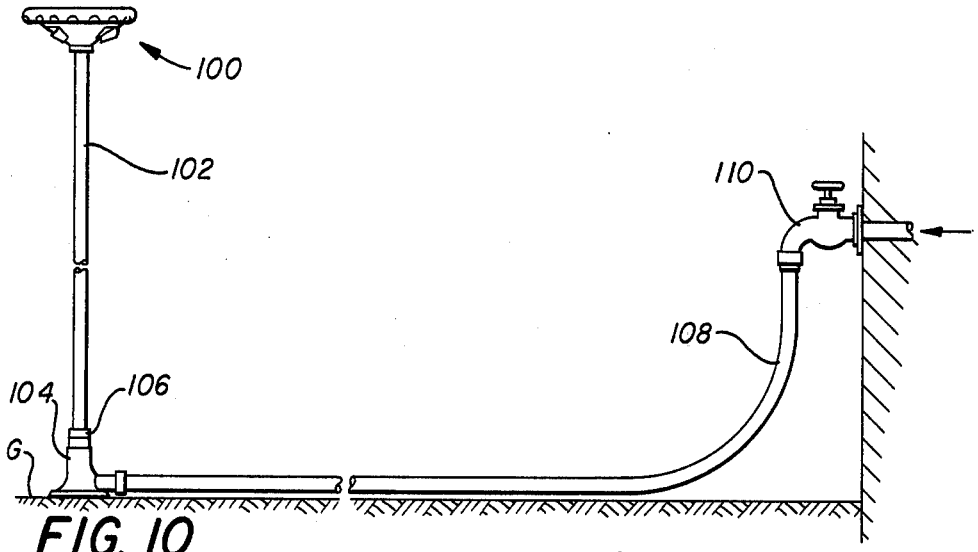
FIG. 10 is an illustration of a fourth embodiment of the invention.

Referring to FIG. 10, there is shown a hover toy 100 incorporating a fourth embodiment of the invention. The hover toy 100 is mounted for rotation at one end of a section of tube 102. The tube 102 can be either flexible or semi-rigid. The other end of the tube 102 is connected to a stand 104 resting on or spiked to the ground G. Preferably, the tube 102 is coupled to stand 104 with a conventional swivel or rotary connection 106. A section of garden hose 108 extending from a water faucet 110 is also connected to the stand 104. The hose 108, stand 104 and tube 102 thus comprise a means for conducting fluid from the faucet 110 to the hover toy 100. The stand 104 anchors tube 102, which is raised to the position shown in FIG. 10 by hover toy 100 during operation.

Figure 11:
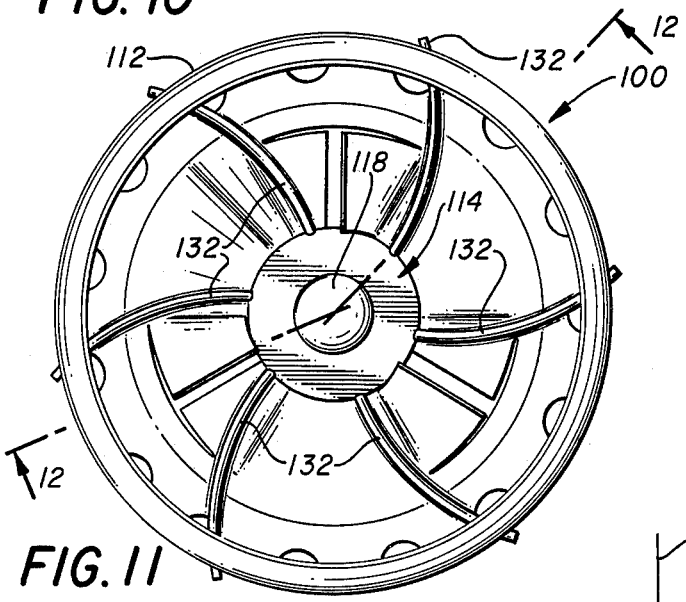
FIG. 11 is an enlarged top view of the embodiment shown in FIG. 10.
Figure 12:
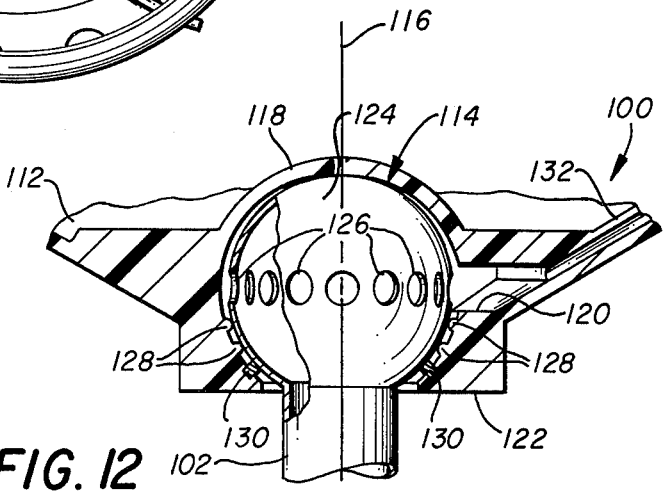
FIG. 12 is an enlarged cross sectional view of the water chamber in the fourth inventive embodiment.

The constructional details of the hover toy 100 can be seen in FIGS. 11 and 12. The hover toy 100 includes a generally circular body 112 having a bowl-shaped configuration. The body 112 is preferably constructed of lightweight material, such as plastic or the like. The body 112 is illustrated as similar in construction to the body 24 of the hover toy 10. It will be understood that the construction of the body 112 can be similar to any one of the bodies for hover toys 10, 60 or 80 described herein above. If desired, a conventional concave-convex flying toy of the type suited for throwing through the air in free flight can be modified to serve as body 112.

The body 112 of the hover toy 100 includes a socket 114, which is best shown in FIG. 12. The socket 114 is preferably located along the spin axis 116, about which the body 112 is substantially symmetrical. The socket 114 is preferably integral with the body 112, and is defined by upper and lower walls 118 and 120 having opposed semi-circular profiles therein. The lower wall 120 preferably includes an upset or collar 122 with an inlet port for the socket 114.

The tube 102 includes a round or ball-shaped end 124 which is received within the socket 114 defined by the walls 118 and 120. The round end 124 of launch tube 102 includes a plurality of circumferentially spaced apart ports 126 located between walls 118 and 120. Circular ridges 128 are provided on the interior surface of lower wall 120 to support the end of launch tube 102 and to allow a small layer of fluid therebetween. A circular seal 130 is also provided in the lower wall 120 beneath ridges 128. The body 112 of the hover toy 100 is thus attached to the top of tube 102 with a ball-joint type connection.

A plurality of outlet tubes 132 open onto the socket 114 through the upper wall 118. Fluid received by socket 114 is thus discharged through tubes 132. It will be understood that each outlet tube 132 individually receives liquid through ports 126 from the end of launch tube 102. For purposes of illustration, the hover toy 100 is shown with six tubes 132, although any desired number of outlet tubes can be employed. The terminal ends of outlet tubes 132 are angled downward at about 45° to the horizontal, and extend substantially tangential or slightly outward from the body 112 in a direction opposite to the rotational direction.

Discharge of fluid from the outlet tubes 132 thus effects propulsion of the hover toy 100. The toy 100 rises to the upper position as soon as enough lift is generated. Rotation of the toy 100 in a level orientation is maintained by means of variable fluid flow through outlet tubes 132. If the toy 100 becomes unbalanced, by a gust of wind for example, the body 112 will tilt relative to tube 102. Some of the ports 126 will then be covered to decrease or halt fluid flow on the high side of the body. The lift on the low side of the body 112 will therefore be increased to tilt the body back to a level attitude. It will be understood that this self-orienting capability of the toy 100 comprises a significant feature of this embodiment. The ball-joint connection employed by toy 100 results in even better stability as the device hovers at the end of tube 102.

From the foregoing, it will be understood that the present invention comprises a novel water propelled hover device having numerous advantages over the prior art. One significant advantage involves the fact that the device employs gyroscopic effects to achieve stability. The device hovers over a given spot while spinning and spraying fluid downward, and operates on readily available water pressure. While the device herein has been described with specific reference to application as a toy, it will be apparent that the device could be utilized as an aerial sprinkler, fire extinguisher or the like. Other advantages and applications will suggest themselves to those skilled in the art.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and/or elements without departing from the spirit and scope of the invention.

We claim:

1. A rotatable tethered hover toy adapted for use with a grounded source of water under pressure, comprising:

a fluid supply chamber having a central longitudinal spin axis extending therethrough;

said fluid supply chamber having a bottom end with an inlet coaxial with the spin axis, and plural outlets arranged substantially symmetrically with said spin axis;

a circular rim independent of said fluid supply chamber and surrounding said fluid supply chamber;

structure rigidly connected between said fluid supply chamber and rim for generating lifting force upon rotation with said fluid supply chamber and rim about the spin axis;

a first tubing section having upper and lower ends;

a first rotary connection coupled between the upper end of said first tubing section and the inlet of said fluid supply chamber;

a second tubing section having upper and lower ends and being relatively longer than said first tubing section;

a second rotary connection coupled between the lower end of said first tubing section and the upper end of said second tubing section;

the lower end of said second tubing section being adapted for connection to the grounded water pressure source; and a plurality of generally radially extending fluid discharge conduits each having an inner end connected to an outlet of said fluid supply chamber and an outer end, the outer ends of said conduits terminating at said rim and being oriented downwardly and outwardly such that reaction forces due to water discharging therefrom cause said rim, fluid supply chamber and connecting structure to spin and hover while tethered by said first and second tubing sections.

2. The hover toy of claim 1, wherein said first rotary connection comprises a ball joint to permit spinning and tilting of said rim, fluid supply chamber, and interconnecting structure relative to said first tubing section.

3. The hover toy of claim 1, wherein said connecting structure comprises a dished body having convex and concave surfaces and a plurality of circumferentially spaced openings with associated flaps oriented in the spin direction for gathering air and generating lifting force.

4. The hover toy of claim 1, wherein said connecting structure comprises a plurality of radial vanes configured for gathering air and generating lifting force.

5. A rotatable tethered hover toy adapted for use with a grounded source of water under pressure, comprising:

a fluid supply chamber having a central longitudinal spin axis extending therethrough;

said fluid supply chamber having a bottom end with an inlet coaxial with the spin axis, and plural outlets arranged substantially symmetrically with said spin axis;

a circular rim independent of said fluid supply chamber and surrounding said fluid supply chamber;

structure rigidly connected between said fluid supply chamber and rim for generating lifting force upon rotation with said fluid supply chamber and rim about the spin axis;

a first tubing section having upper and lower ends;

a first rotary connection coupled between the upper end of said first tubing section and the inlet of said fluid supply chamber;

a stand adapted for connection to the grounded water pressure source;

a second rotary connection coupled between the lower end of said first tubing section and said stand; and a plurality of generally radially extending fluid discharge conduits each having an inner end connected to an outlet of said fluid supply chamber and an outer end, the outer ends of said conduits terminating at said rim and being oriented downwardly and outwardly such that reaction forces due to water discharging therefrom cause said rim, fluid supply chamber and connecting structure to spin and hover while tethered by said first and second tubing sections.

6. The hover toy of claim 5, wherein said first rotary connection comprises a ball joint to permit spinning and tilting of said rim, fluid supply chamber, and interconnecting structure relative to said first tubing section.

7. The hover toy of claim 5, wherein said interconnecting structure comprises a dished body having convex and concave surfaces and a plurality of circumferentially spaced openings with associated flaps oriented in the spin direction for gathering air and generating lift.

8. The hover toy of claim 5, wherein said connecting structure comprises a plurality of radial vanes configured for gathering air and generating lift.

9. A rotatable tethered hover toy adapted for use with a grounded source of water under pressure, comprising:

a fluid supply chamber having a central longitudinal spin axis extending therethrough;

said fluid supply chamber having a bottom end with an inlet coaxial with the spin axis, and plural outlets arranged substantially symmetrically with said spin axis;

a circular rim independent of said fluid supply chamber and surrounding said fluid supply chamber, said rim having plural circumferentially spaced openings therein;

a dished body rigidly connected between said fluid supply chamber and rim for generating lifting force upon rotation with said fluid supply chamber and rim about the spin axis;

said dished body having convex and concave surfaces and plural circumferentially spaced openings with associated flaps oriented in the spin direction for gathering air;

a first tubing section having upper and lower ends;

a rotary connection coupled between the upper end of said first tubing section and the inlet of said fluid supply chamber;

the lower end of said first tubing section being adapted for connection to the grounded water source; and plural generally radially extending fluid discharge conduits each having an inner end connected to an outlet of said fluid supply chamber and an outer end, the outer ends of said conduits extending through the openings in said rim and being oriented downwardly and outwardly such that reaction forces due to water discharging therefrom cause said rim, fluid supply chamber and body to spin and hover while tethered by said first tubing section.

* * * * *